US011172747B2

(12) United States Patent
Salmon et al.

(10) Patent No.: US 11,172,747 B2
(45) Date of Patent: Nov. 16, 2021

(54) SUPPORT FOR USE IN COSMETIC OR LEISURE ACTIVITY

(71) Applicant: NAILPAD LTD., Twickenham (GB)

(72) Inventors: James Robert Salmon, London (GB); Joseph Daniel Deely, Middlesex (GB); Caroline Emma Salmon, London (GB); Victoria Jane Deely, Middlesex (GB)

(73) Assignee: NAILPAD LTD., Twickenham (GB)

( * ) Notice: Subject to any disclaimer, the term of this patent is extended or adjusted under 35 U.S.C. 154(b) by 772 days.

(21) Appl. No.: 15/831,768

(22) Filed: Dec. 5, 2017

(65) Prior Publication Data

US 2019/0166971 A1 Jun. 6, 2019

(51) Int. Cl.

| | |
|---|---|
| ***A45D 29/22*** | (2006.01) |
| ***A45D 34/00*** | (2006.01) |
| ***A45D 29/00*** | (2006.01) |

(52) U.S. Cl.

CPC ..... *A45D 29/22* (2013.01); *A45D 29/00* (2013.01); *A45D 34/00* (2013.01); *A45D 2034/002* (2013.01); *A45D 2200/00* (2013.01)

(58) Field of Classification Search

CPC .. A45D 29/22; A45D 2034/002; A45D 34/00; A45D 29/00; A45D 2200/00; A45F 5/00; A45F 2200/0516; A45F 2200/0525; A47G 23/06; A47G 23/0616; B65D 1/34; A47B 31/00

USPC ..... 294/25

See application file for complete search history.

(56) References Cited

U.S. PATENT DOCUMENTS

| | | | | |
|---|---|---|---|---|
| 564,711 | A * | 7/1896 | O'Brien | A47B 3/087 108/35 |
| 1,728,431 | A | 9/1929 | Mevi | |
| 1,957,039 | A | 5/1934 | Buenger et al. | |
| 1,980,930 | A * | 11/1934 | Reyniers | B01L 9/06 211/74 |
| 2,039,922 | A * | 5/1936 | Neats | A47G 23/0608 108/25 |
| 2,392,626 | A * | 1/1946 | Young | A45D 29/22 132/73 |
| 2,647,678 | A | 5/1950 | Olson | |
| 2,556,261 | A | 6/1951 | Dubach | |

(Continued)

FOREIGN PATENT DOCUMENTS

| | | |
|---|---|---|
| AT | 514182 A1 | 10/2014 |
| DE | 52154 C | 12/1889 |

(Continued)

OTHER PUBLICATIONS

Amazon, Suptek Aluminum Tablet Desk Mount Stand 360° Flexible Cell Phone Holder for iPad, iPhone, Samsung, Asus and More 4.7-11 inch Devices, Good for Bed, Kitchen, Office (YF208B), Sep. 29, 2017, pp. 1-6 (Year: 2017).*

(Continued)

*Primary Examiner* — Stephen A Vu
(74) *Attorney, Agent, or Firm* — Louis Woo

(57) ABSTRACT

A support for use in a leisure activity or cosmetic treatment in a reclined position wherein the support includes two sections connected by a section hinge wherein a first section includes a leg connected by a leg hinge to the first section where the leg hinge is substantially perpendicular to the section hinge.

18 Claims, 6 Drawing Sheets

(56) References Cited

U.S. PATENT DOCUMENTS

| | | | | |
|---|---|---|---|---|
| 2,934,386 | A * | 4/1960 | Shore | A47B 3/087 108/35 |
| 3,121,576 | A | 2/1964 | Stanley | |
| 3,361,091 | A | 1/1968 | Inman | |
| 4,043,277 | A * | 8/1977 | Wallace | A47B 3/083 108/35 |
| 4,049,091 | A | 9/1977 | Chubb | |
| 4,679,757 | A | 7/1987 | Mussari | |
| 4,934,549 | A | 6/1990 | Allen | |
| 5,248,030 | A | 9/1993 | Tarozzi | |
| 5,265,541 | A | 11/1993 | Gordon | |
| 5,496,360 | A | 3/1996 | Hoffmann et al. | |
| 6,349,729 | B1 | 2/2002 | Meyer et al. | |
| 7,252,040 | B2 * | 8/2007 | Dumond | A47B 3/087 108/169 |
| 9,062,819 | B1 | 6/2015 | Chen | |
| 9,504,314 | B2 * | 11/2016 | Leng | A47B 3/0916 |
| 2002/0069793 | A1 | 6/2002 | Clores | |
| 2004/0107878 | A1 | 6/2004 | Podd | |
| 2006/0157630 | A1 | 7/2006 | Buote | |
| 2009/0025745 | A1 | 1/2009 | Gonterman | |
| 2009/0200324 | A1 * | 8/2009 | Geelen | B65D 43/0212 220/780 |
| 2011/0121156 | A1 | 5/2011 | Lee et al. | |
| 2011/0185951 | A1 | 8/2011 | Aguayo | |
| 2012/0074034 | A1 | 3/2012 | Bar | |
| 2014/0261105 | A1 * | 9/2014 | Nafziger | A47B 9/20 108/97 |
| 2015/0034793 | A1 | 2/2015 | Roth | |
| 2015/0068433 | A1 * | 3/2015 | Nardi | A47B 13/16 108/25 |

FOREIGN PATENT DOCUMENTS

| | | | |
|---|---|---|---|
| DE | 671474 | C | 2/1939 |
| GB | 2365821 | A | 2/2002 |
| WO | 2005/018381 | A1 | 3/2005 |

OTHER PUBLICATIONS

UK Combined Search and Examination Report re: application No. GB1502369.0 dated Sep. 7, 2015; UK/IPO.

UK Search Report re: application No. GB1610228.7 dated Apr. 4, 2017; UK/IPO.

UK Search Report re: application No. GB1709381.6 dated Jul. 13, 2017; UK/IPO.

EP Extended Search Report re: application No. EP17194247 dated Apr. 19, 2018; EPO.

* cited by examiner

SUPPORT FOR USE IN COSMETIC OR LEISURE ACTIVITY

The present invention relates to a support for use in supporting an activity such as a cosmetic treatment in a reclined position.

Cosmetic treatments such as fingernail care require a number of tools. A stable work surface is needed because the treatment uses sharp tools and an oil based polish which is difficult to clear up if spilled. People in need of such cosmetic treatment usually do it while seated at a table but would prefer to do in a more relaxed posture.

A way of ameliorating these problems has been sought.

According to the invention there is provided a support for use in a leisure activity or cosmetic treatment by a user wherein the support comprises two sections connected by a section hinge wherein a first section has a single leg suitable for being held between a user's legs wherein the leg is connected by a leg hinge to the first section and where the leg hinge is substantially perpendicular to the section hinge.

Advantages of the invention include that by having the leg hinge substantially perpendicular to the section hinge, a user may easily use the support in a reclined position by securing the first section in a substantially horizontal position on their knees by extending the leg from the support and gripping the leg between their knees such that the section hinge allows the support to fold in a manner corresponding to the angle between the person's knees and upper legs such that the other section rests on the person's thighs and can be used as a convenient support for the treatment or the activity. When the leg is in a stored position, the support may be used on a flat surface such as a table top.

In some embodiments, the first section may form a container holder on its upper surface for receiving a container for use in a cosmetic treatment such as a nail polish bottle or a container for use in a leisure activity such as a food or drinks container. Advantages of having a container holder in the first section include that a bottle or cup placed in the holder should not spill because in use the first section is supported in a substantially horizontal position.

In some embodiments, the support may be a compact support such that it may be a portable support, for example having two configurations which comprise an open configuration and a closed configuration. In some embodiments, the section hinge is arranged to divide the support into the two sections such that the two sections have substantially corresponding shapes. In some embodiments, the support may have a circular shape; the section hinge may be diametric; the support may have a clam shell shape when in a closed configuration. In some embodiments, the support may have a rectilinear shape, for example a rectangular or sguare shape.

In some embodiments, the support has two arrangements when in an open configuration which are a table top arrangement where the leg is in a stored position such that the support may be used on a flat surface such as a table top; and a reclined arrangement where the leg is rotated to an extended position such that the support can be used by a person in a reclined position.

In some embodiments, the two sections may have correspondingly shaped circumferential features which engage when the support is in a closed configuration to form a sealed container. In some embodiments, the two sections may comprise a resilient material to reduce slipping when the support is used on a smooth surface.

In some embodiments, the support may comprise a container closure to secure the support in its closed configuration.

In some embodiments, the container holder may have a flexible shape such that containers of different sizes may be supported by it.

In some embodiments, the leg may have one or more stops to prevent its over-rotation beyond an angle of about 90° to the lower surface of the first section. In some embodiments, the one or more stops may comprise a leg lip or one or more leg tabs. In some embodiments, the leg may comprise a leg lock to secure the leg in its extended position. In some embodiments, the leg may form a finger hole for ease of use in moving the leg. In some embodiments, the leg may be an extendable leg; for example, the leg may have a telescopic section.

In some embodiments, the support comprises a second section which has an upper surface which forms a support surface for the leisure activity or cosmetic treatment. In some embodiments, the second section may have a lower surface provided with one or more clips for storing one or more tools for use in a cosmetic treatment such as a manicure tool for example a nail file, nail clipper, pair of tweezers, cuticle cutters and/or a brush. In some embodiments, the second section may comprise a hinged fastening for attachment to an electronic device such as a tablet computer or a smart phone; the hinged fastening may be magnetic.

In some embodiments, the leg may have a planar shape, in particular the leg may be formed from a plate of plastics material. Having a planar-shape, leg is easier for a user to grip between their legs. In some embodiments, the leg may be shaped to fold into half of the first section. In some embodiments, the leg hinge may be arranged across the middle of the first section such that the support is balanced when its leg is gripped between a user's legs.

The invention will now be illustrated with reference to the following Figures of the accompanying drawings which are not intended to limit the scope of the claimed invention:

Figure 1:
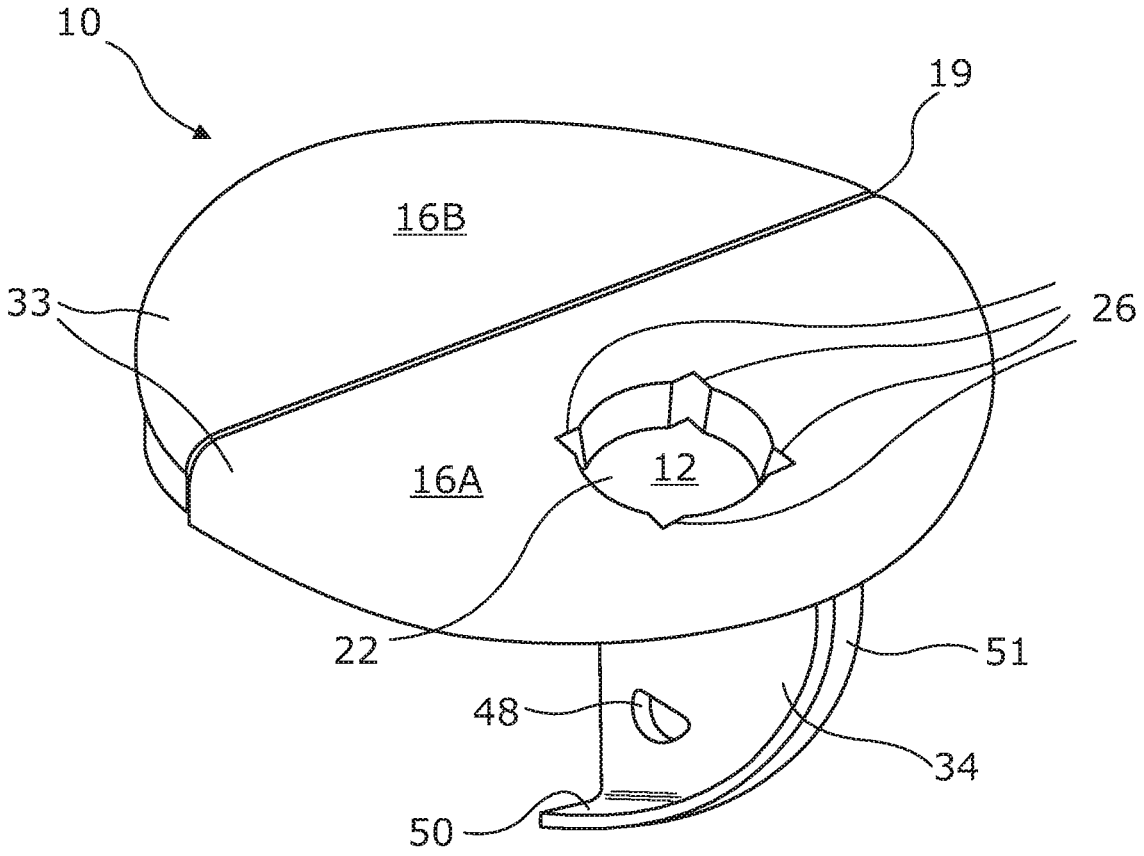
FIG. 1 shows a schematic perspective view of a first embodiment of the support according to the invention.
Figure 2:
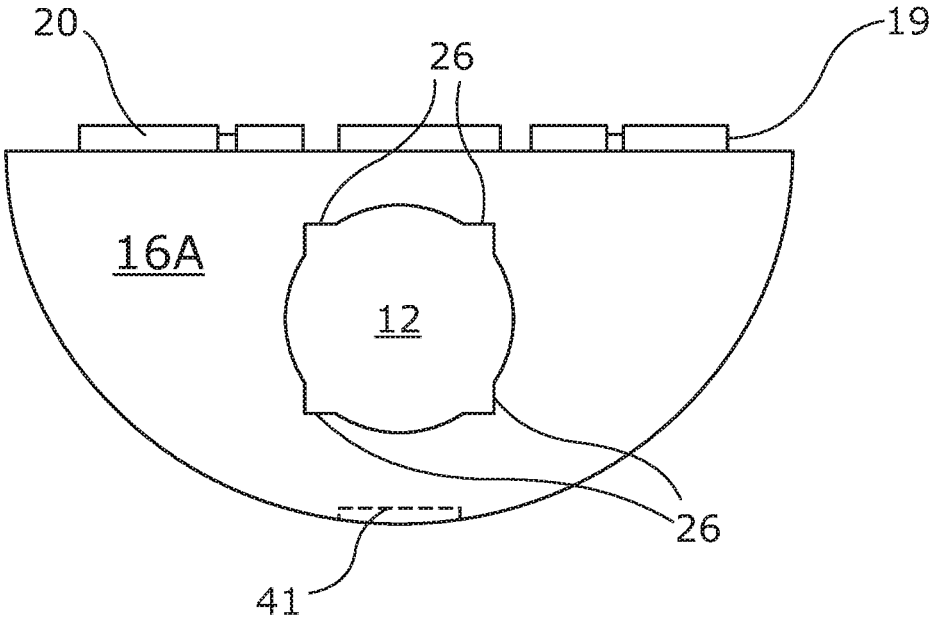
FIG. 2 shows a schematic plan view of the first section of the first embodiment of the support.
Figure 3:
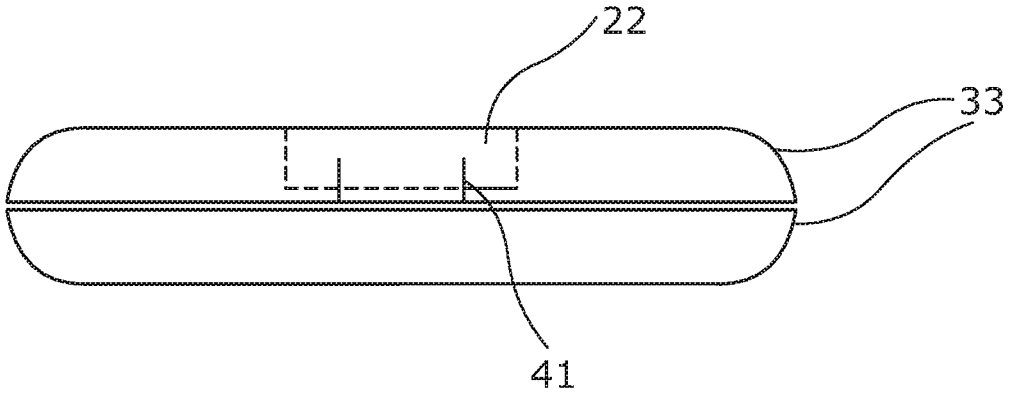
FIG. 3 shows a schematic side view of the first embodiment of the support in a closed configuration.
Figure 4:
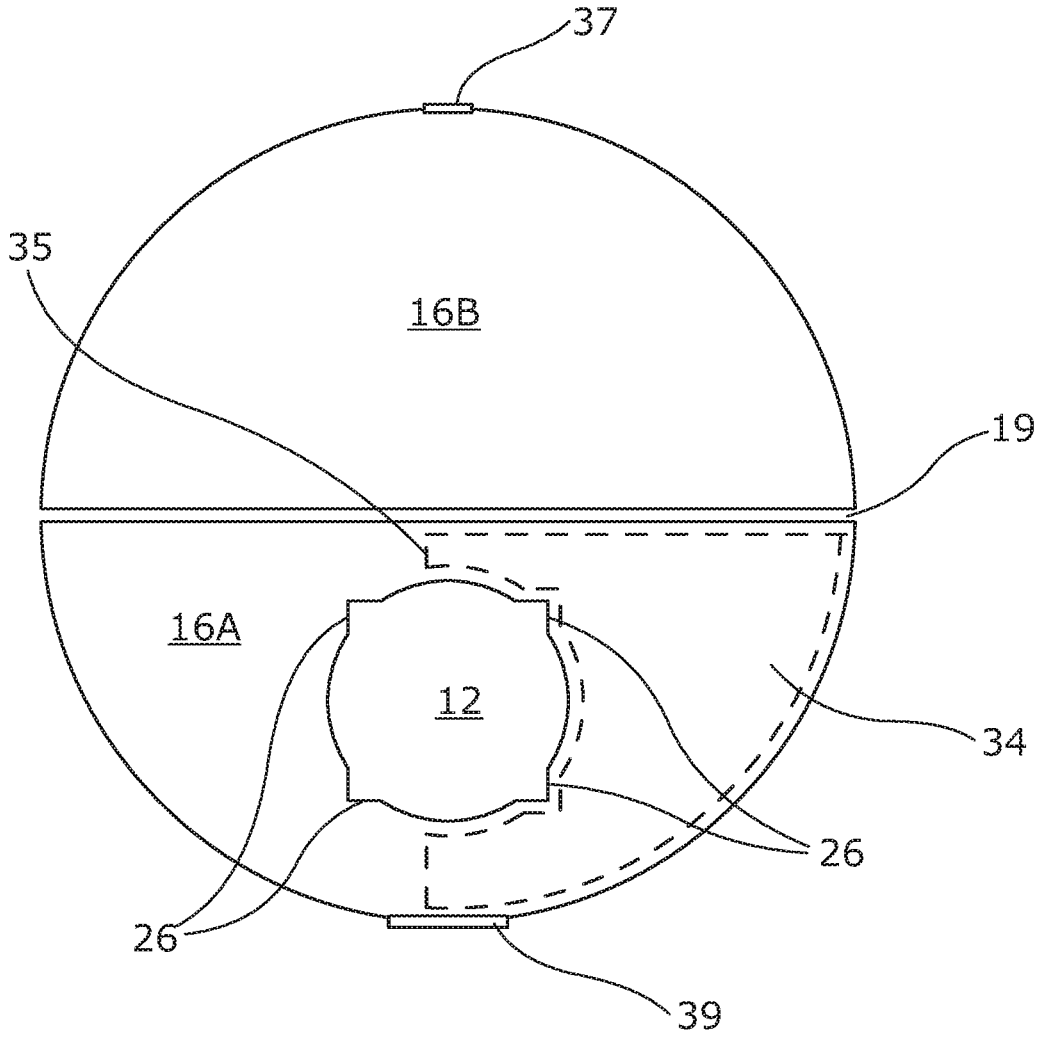
FIG. 4 shows a schematic overhead plan view of the first embodiment of the support.
Figure 5:
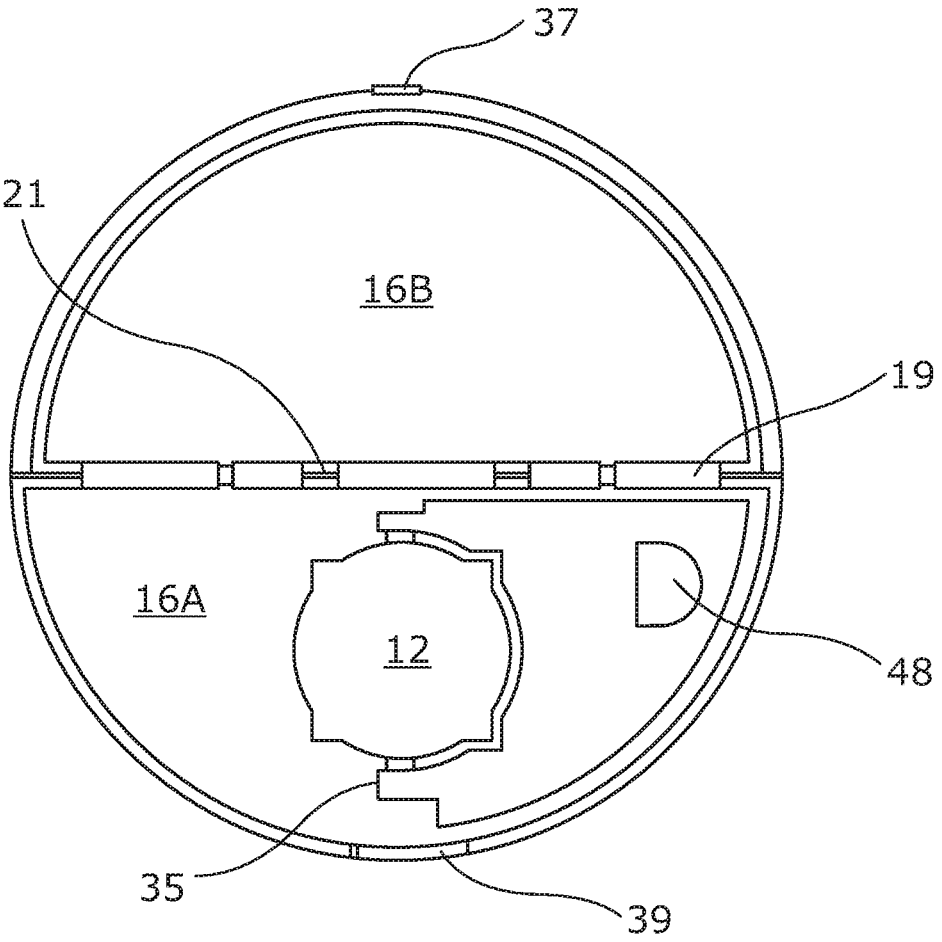
FIG. 5 shows a schematic plan view of the first embodiment of the support from below.
Figure 6:
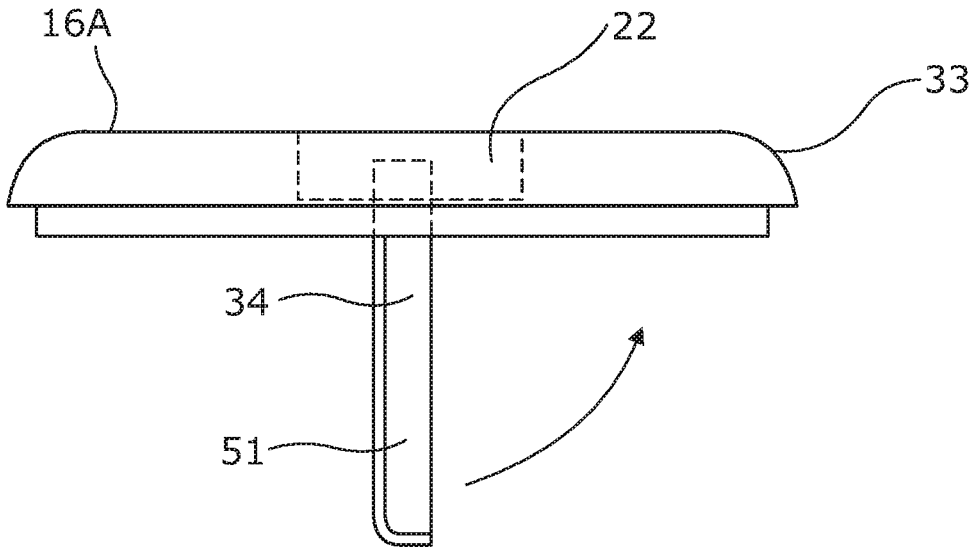
FIG. 6 shows a schematic side view of the first embodiment of the support in an open configuration and with the leg extended.

A first embodiment of the support according to the invention is indicated generally at 10 on FIG. 1 of the drawings. Support 10 is further illustrated in FIGS. 2, 3, 4, 5 and 6 of the drawings. Support 10 has a circular shape when in an open configuration shown in FIG. 1. Support 10 has a diametric section hinge 19 such that support 10 is formed from two semi-circular sections which are first section 16A and a second section 16B. Support 10 has a clam shell-shape when in a closed configuration shown in FIG. 2. First and second sections 16A, 16B have rounded circumferential edges 33 and tubular hinge-forming sections 20 along their straight diametric edge. Section hinge 19 is formed by the inter-engaging tubular sections 20 and hinge pin 21. In an alternative embodiment, the support 10 may have a different shape such as a square, rectangular or polygonal shape and section hinge 19 may be positioned so as to divide the support 10 into two sections 16A, 16B having a corresponding shape.

First section 16A has a circumferential flange 17 and second section 16B has an indented circumferential rim 18 such that when the support 10 is folded about section hinge 19 into a closed configuration, flange 17 engages rim 18 such that support 10 forms a sealed container. In an alternate embodiment, flange 17 and rim 18 may be formed from a resilient material such that the support 10 may be used on a smooth surface without sliding across when pressure is applied to it.

First section 16A and second section 16B form a container closure 41 on their outer edge. Container closure 41 comprises a container closure hook 39 provided on first section 16A and a container closure clip 37 on second section 16B. In use when the support 10 is in its closed configuration, container closure hook 39 engages container closure clip 37 to secure the support 10 in its closed configuration.

First section 16A has an upper surface which forms a container holder 12 at its centre and a lower surface having a quadrant-shaped leg 34. Container holder 12 has a generally circular shape with outdented corners 26 such that the container holder 12 can accommodate bottles (not shown) having a range of different sizes. In an alternative embodiment, the container holder 12 may be lined with a resilient material to support a bottle. In an alternative embodiment, the container holder 12 may have a plurality of concentric foam rings such that by selection of the appropriately sized ring, bottles of different diameters may be accommodated and supported.

Quadrant-shaped leg 34 is attached to the lower surface of first section 16A by a two-part radial leg hinge 35 where each part of leg hinge 35 is arranged on each side of container holder 12. Support 10 thus has a single leg 34. Leg 34 has a planar shape and is formed from a plate of plastics material. Having a planar-shape, leg 34 is suitable for being held between a user's legs. Leg 34 is quadrant-shaped so that it can be folded into half of the semi-circular shaped first section 16A. By being formed on the lower surface of first section 16A, leg 34 is folded inside support 10 when it is in its closed configuration. Leg hinge 35 is substantially perpendicular to section hinge 19. Leg hinge 35 is arranged across the middle of section 16A such that it substantially bisects section 16A so that the support 10 is balanced when leg 34 is gripped between a user's legs. Leg hinge 35 is substantially perpendicular to diametric hinge 19. Leg 34 is shaped to fit around container holder 12 when it is folded into a stored position. Leg 34 has a lip 50 which is shaped to engage the lower surface of first section 16A when the leg 34 is extended by supporting the leg 34 when it is in its extended position which is a position substantially perpendicular to the lower surface of first section 16A and to prevent leg 34 from over-rotating beyond an angle of about 90° to the first section 16A. Lip 50 further helps a user grip leg 34 between their legs by helping to stop leg 34 from sliding when the support 10 is in use. Leg 34 forms a finger hole 48 for ease of use in moving leg 34. In an alternative embodiment, instead of lip 50, leg 34 may have one or more tabs at its hinge end wherein the tabs are shaped to engage the lower surface of first section 16A when the leg 34 is extended and to prevent leg 34 from over-rotating beyond an angle of about 90° to the first section 16A. In an alternative embodiment, the leg 34 may have a leg lock comprising a resilient formation at the hinge end of leg 34 which is arranged to engage with a corresponding indent on the leg hinge 35 or on the lower surface of the first section 16A such that the leg lock secures the leg 34 when it is in its extended position. In a further alternative embodiment, the leg lock may comprise a resilient formation arranged on the leg hinge 35 or on the lower surface of the first section 16A and an indent may be arranged on leg 34. In a further alternative embodiment, the leg 34 may be an extendable leg with a telescopic section to help stability of the support in use.

Second section 16B has an upper surface which forms a work surface for a cosmetic treatment. Second section 16B has a lower surface provided with one or more clips (not shown) for storing one or more tools for use in a cosmetic treatment such as a manicure tool for example a nail file, nail clipper, pair of tweezers, cuticle cutters and/or a brush.

In use, a person may use support 10 whilst applying a cosmetic treatment such as nail polish to their finger nails in a reclined position by using support 10 in its open configuration with its leg 34 in its extended position. The person can secure the first section 16A in a substantially horizontal position on their knees by gripping leg 34 between their knees. Section hinge 19 then allows the support 10 to fold in a manner corresponding to the angle between the person's knees and upper legs such that the second section 16B rests on the person's thighs and can be used as a convenient support for the treatment. A nail polish bottle can be placed in container holder 12 of the first section 16A which bottle will not spill because the first section 16A is supported in a substantially horizontal position.

Figure 7:
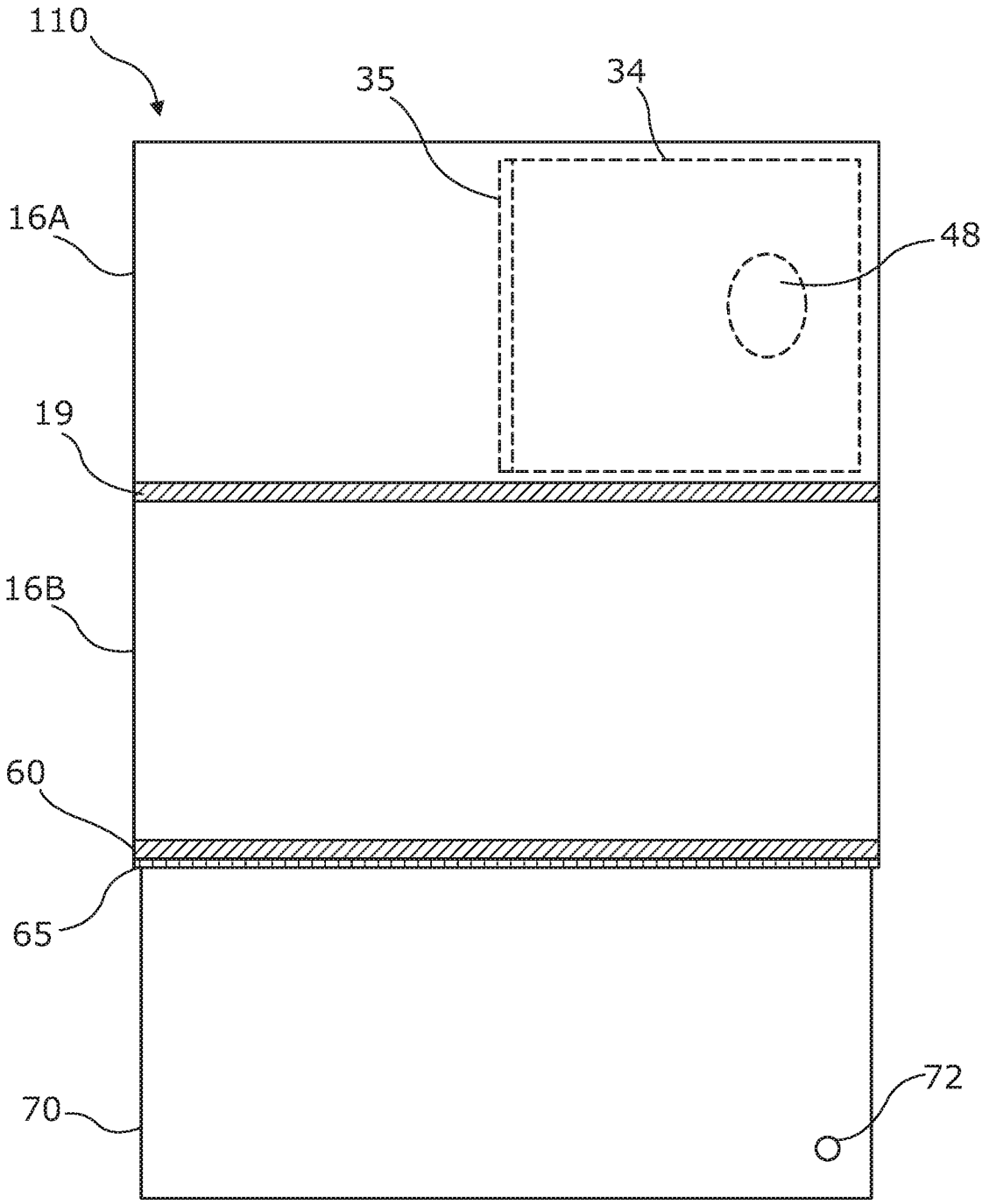
FIG. 7 shows a schematic overhead plan view of a second embodiment of the support according to the invention with an electronic device.
Figure 8:
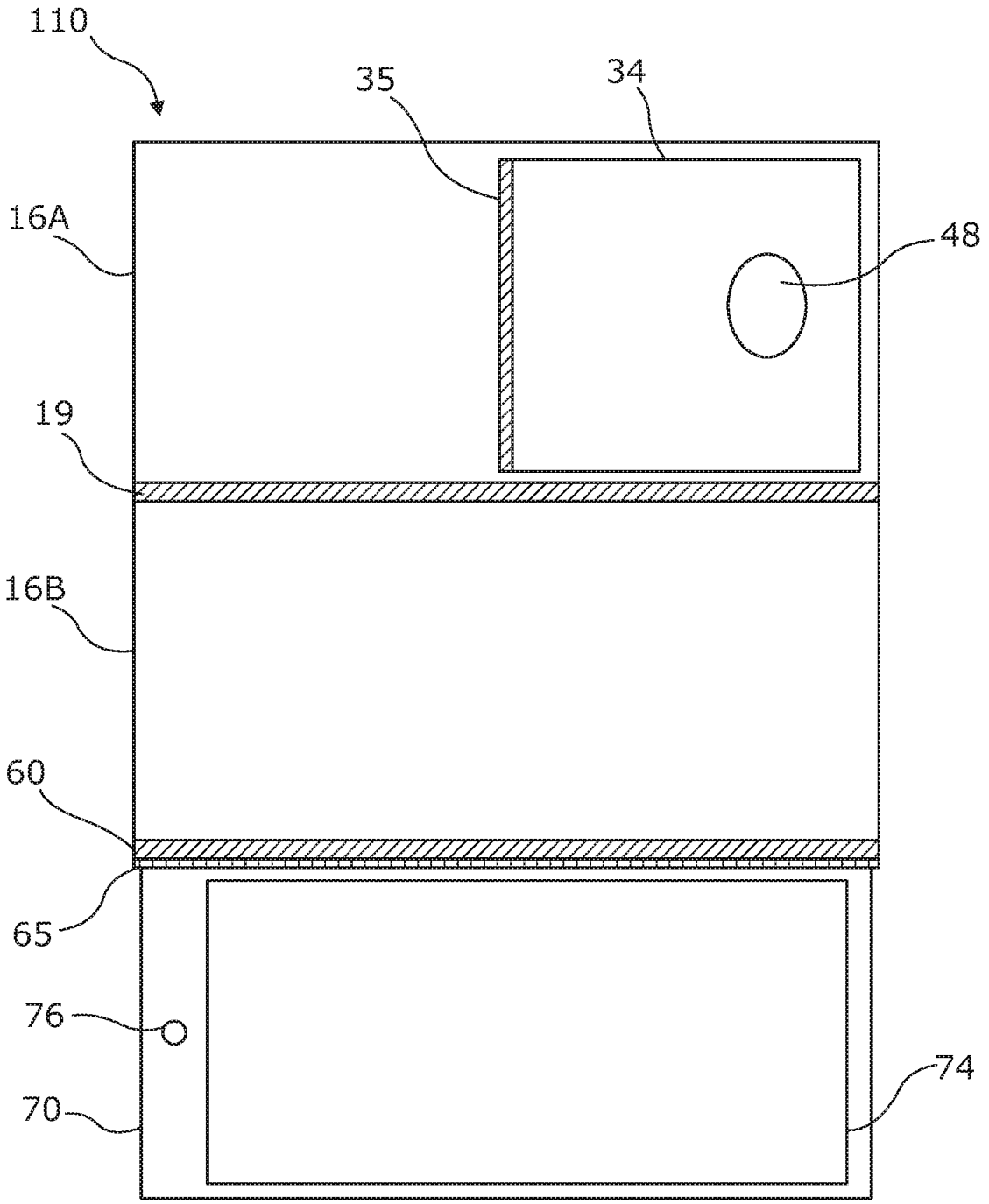
FIG. 8 shows a schematic plan view from below the second embodiment of the support with an electronic device.

A second embodiment of a support according to the invention is indicated generally at 110 on FIGS. 7 and 8 of the accompanying drawings. In FIGS. 7 and 8, like reference numerals are used for the second embodiment of the support 110 to the reference numerals used for the first embodiment of the support 10. Support 110 is shown in FIGS. 7 and 8 with an electronic device 70 mounted on it. Support 110 has a generally square shape which is divided into two sections 16A, 16B by section hinge 19 such that sections 16A, 16B have substantially the same rectangular shape. First section 16A has a leg 34 on its lower side. Leg 34 is attached to the first section 16A by a leg hinge 35 which is positioned on first section 16A to be at an angle of about 90° to the section hinge 19 as for support 10. Leg 34 forms a finger hole 48. In an alternative embodiment, first section 16A may form a container holder (not shown) to accommodate a drinks bottle or cup.

Support 110 has a single leg 34. Leg 34 has a planar shape and is formed from a plate of plastics material. Having a planar-shaped, leg 34 is easier for a user to grip between their legs. Leg 34 is square-shaped so that it can be folded into half of the rectangular first section 16A. By being formed on the lower surface of first section 16A, leg 34 is folded inside support 110 when it is in its closed configuration. Leg hinge 35 is arranged across the middle of section 16A such that it substantially bisects section 16A so that the support 10 is balanced when leg 34 is gripped between a user's legs.

Second section 16B has a support hinge 60 on its other longitudinal edge opposing section hinge 19. Support hinge 60 has a magnetic fastening 65 for attachment to the electronic device 70. The electronic device 70 is shown on FIG. 7 to have a camera 72 on its rear side and on FIG. 8 to have a display screen 74 and a control button 76. The electronic device 70 may be a tablet computer or smart phone. In use, electronic device 70 may be folded on to the upper side of second section 16B such that its screen 74 faces a user. Depending upon the size of the electronic device 70, the support 110 may act as a protective container for the electronic device 70.

In use, a person may use support 110 whilst using the electronic device 70 in a reclined position by using support 110 in its open configuration with its leg 34 in its extended position. The support 110 allows a person to watch a movie or engage in a video call without having to hold the electronic device 70; in other words, the support 110 allows hands-free use of the electronic device 70. The person can secure the first section 16A in a substantially horizontal position on their knees by gripping leg 34 between their knees. Section hinge 19 then allows the support 110 to fold in a manner corresponding to the angle between the person's knees and upper legs such that the second section 16B rests on the person's thighs and can be used as a convenient support for the electronic device 70.

The invention claimed is:

1. A support for use in a leisure activity or cosmetic treatment wherein the support consists of two sections, a section hinge, a single leg, and a leg hinge wherein the two sections are connected by the section hinge wherein a first section has the single leg suitable for being held between a user's legs wherein the leg is connected by the leg hinge to the first section and where the leg hinge is substantially perpendicular to the section hinge and wherein the leg hinge is arranged across the middle of the first section such that the support is balanced when its leg is gripped between a user's legs.

2. A support as defined in claim 1 wherein the first section may form a container holder on its upper surface for receiving a container for use in a cosmetic treatment or a container for use in a leisure activity.

3. A support as defined in claim 1 wherein the section hinge is arranged to divide the support into the two sections such that the two sections have substantially corresponding shapes.

4. A support as defined in claim 1 wherein the support has a circular shape and the section hinge is diametric.

5. A support as defined in claim 1 wherein the support has a rectilinear shape.

6. A support as defined in claim 1 wherein the two sections have correspondingly shaped circumferential features which engage when the support is in a closed configuration to form a sealed container.

7. A support as defined in claim 1 wherein the two sections comprise a resilient material to reduce slipping when the support is used on a smooth surface.

8. A support as defined in claim 1 wherein the leg has one or more stops to prevent its over-rotation beyond an angle of about 90° to a lower surface of the first section.

9. A support as defined in claim 8 wherein the one or more stops comprises a leg lip or one or more leg tabs.

10. A support as defined in claim 1 wherein the leg comprises a leg lock to secure the leg in its extended position.

11. A support as defined in claim 1 wherein the leg forms a finger hole for ease of use in moving the leg.

12. A support as defined in claim 1 wherein the leg is an extendable leg.

13. A support as defined in claim 12 wherein the leg has a telescopic section.

14. A support as defined in claim 1 wherein the support comprises a second section which has an upper surface which forms a support surface for the leisure activity or cosmetic treatment.

15. A support as defined in claim 14 wherein the second section comprises a hinged fastening for attachment to an electronic device.

16. A support as defined in claim 1 wherein the leg has a planar shape.

17. A support as defined in claim 1 wherein the leg is shaped to fold into half of the first section.

18. A support for use in a leisure activity or cosmetic treatment wherein the support consists of two sections, a section hinge, a single leg, a leg hinge and a container closure to secure the support in its closed configuration wherein the two sections are connected by the section hinge wherein a first section has the single leg suitable for being held between a user's legs wherein the leg is connected by the leg hinge to the first section and where the leg hinge is substantially perpendicular to the section hinge and wherein the leg hinge is arranged across the middle of the first section such that the support is balanced when its leg is gripped between a user's legs.

* * * * *